United States Patent [19]

Kroger et al.

[11] Patent Number: 4,907,944

[45] Date of Patent: Mar. 13, 1990

[54] TURBOMACHINERY BLADE MOUNTING ARRANGEMENT

[75] Inventors: Gerard P. Kroger, Cincinnati; Robert A. Peck, Loveland; Ralph A. Kirkpatrick, Mason, all of Ohio

[73] Assignee: General Electric Company, Cincinnati, Ohio

[21] Appl. No.: 655,792

[22] Filed: Oct. 1, 1984

[51] Int. Cl.[4] ..... F01D 1/26

[52] U.S. Cl. ..... 415/65; 415/190; 415/209.3; 416/215

[58] Field of Search ..... 415/189, 190, 216, 217, 415/65, 77, 91; 416/215, 216

[56] References Cited

U.S. PATENT DOCUMENTS

| | | | |
|---|---|---|---|
| 2,661,147 | 12/1953 | Anderson | 415/218 |
| 2,722,373 | 11/1955 | Ledwith et al. | 230/133 |
| 2,833,463 | 5/1958 | Morley | 230/133 |
| 3,303,998 | 2/1967 | Koff et al. | 230/133 |
| 3,326,523 | 6/1967 | Bobo | 415/218 |
| 3,365,173 | 1/1968 | Lynch et al. | 253/78 |
| 3,448,582 | 6/1969 | Bracey et al. | 60/39.162 X |
| 3,561,884 | 2/1971 | Zerlauth | 415/218 |
| 3,849,023 | 11/1974 | Klompas | 415/172 A X |
| 4,014,627 | 3/1977 | Heurteux | 415/217 X |
| 4,142,827 | 3/1979 | Vinciguerra | 415/189 |

FOREIGN PATENT DOCUMENTS

| | | | |
|---|---|---|---|
| 586560 | 3/1947 | United Kingdom . | |
| 599391 | 3/1948 | United Kingdom | 415/217 |
| 1318167 | 5/1973 | United Kingdom . | |
| 1326122 | 8/1973 | United Kingdom . | |
| 1461958 | 1/1977 | United Kingdom . | |

*Primary Examiner*—Louis J. Casaregola

*Attorney, Agent, or Firm*—Derek P. Lawrence; Nathan D. Herkamp

[57] ABSTRACT

An improved blade mounting arrangement for a gas turbine engine with a turbine and an annular flowpath therethrough is disclosed. The improvement comprises a one-piece outer casing and a one-piece inner casing bounding the flowpath. The outer casing has a plurality of circumferential recesses disposed therein with each of the recesses having first and second axially opposite circumferential slots. A plurality of first turbine blades, each with axially facing tangs on a mounting platform, mate with the slots in the outer casing recess. The inner casing has a plurality of recesses disposed therein, each of the recesses including a forward circumferential slot and concentric aft radially outer and radially inner circumferential slots. A plurality of second turbine blades, each with forward and aft axially facing tangs on a mounting platform, mate with respective ones of forward slot and radially outer slot in the inner casing recess.

13 Claims, 4 Drawing Sheets

TURBOMACHINERY BLADE MOUNTING ARRANGEMENT

This invention relates generally to axial flow turbomachinery and, more particularly, to a casing and blade mounting arrangement for a gas flowpath therein.

BACKGROUND OF THE INVENTION

Gas turbine engines generally include a gas generator comprising: a compressor section with one or more compressors for compressing air flowing through the engine, a combustor in which fuel is mixed with the compressed air and ignited to form a high energy gas stream, and a turbine section which includes one or more rotors for driving the compressor(s). Many engines further include an additional turbine section, known as a power turbine, located aft of the gas generator which extracts energy from the gas flow out of the gas generator to drive an external device such as a fan or a propeller.

Each of the turbines and compressor include one or more bladed rows. Such rows will typically be alternately spaced with interposed vane rows or with counterrotating bladed rows. In either case, alternating rows extend into a flowpath from outer and inner annular casings, respectively.

Individual blades in each row are generally detachable from such casings and mountable therein. Numerous configurations are known for mounting blades in casings. For example, a common configuration includes a circumferential dovetail base which mates with a circumferential recess in the casing. In order to load such blades into the casing, it is known to cut or split the casing axially thereby forming two semicircular casing halves. Blades may then be loaded directly into the circumferential slots at the axial split. After the blades are loaded into each half, the casings are rejoined and fastened with a number of bolts through an axial flange. However, such flanges and bolts add increased weight to the casing structure and may cause out-of-round distortion of the casing with imposed thermal and mechanical operating loads.

An alternative way of assembling blades into a casing is to assemble one row at a time. For example, blades may be mounted in a single hoop forming part of either an outer or inner casing. Casing/airfoil assemblies may then be built up by "stacking" subsequent rows thereon. These assemblies again require numerous fasteners such as bolted flange joints which significantly increase the weight of the assembly.

OBJECTS OF THE INVENTION

It is therefore one object of the present invention to provide a blade mounting arrangement with one-piece outer and inner casings.

It is another object of the present invention to provide a new and improved blade mounting arrangement which is easily assembled.

SUMMARY OF THE INVENTION

The present invention is an improvement for an axial flow turbomachine with an annular flowpath radially bounded by first and second concentric casings. The improvement comprises a one-piece first casing and a one-piece second casing. The one-piece first casing has at least one circumferential recess disposed in a surface facing the flowpath, each recess including axially opposite circumferential slots. The improvement further comprises a plurality of first blades, each with axially facing tangs on a mounting platform adapted to mate with the slots in the first casing recess. The second casing has at least one circumferential recess disposed in a surface facing the flowpath, each recess has a plurality of second blades mounted therein.

The mounting platform of a first blade may be assembled into the first casing recess by inserting the platform into the recess and then twisting the blade and platform so that the tangs mate with the slots of the first casing recess.

In a further embodiment, the circumferential recess in the second casing includes a first circumferential slot and, axially disposed therefrom, concentric radially outer and radially inner circumferential slots. Each of the second blades has first and second axially facing tangs on a mounting platform adapted to mate with respective ones of the first slot and the radially outer slot in the second casing recess. There may also be a relief formed between the outer and inner slots of the second casing recess.

The mounting platform of a second blade is assembled into the second casing recess by inserting the second tang into the radially inner slot, rocking the first tang into the first slot, lifting the second tang through the relief into the radially outer slot, and circumferentially translating the second blade within the first and radially outer slots.

DETAILED DESCRIPTION OF THE INVENTION

Figure 1:
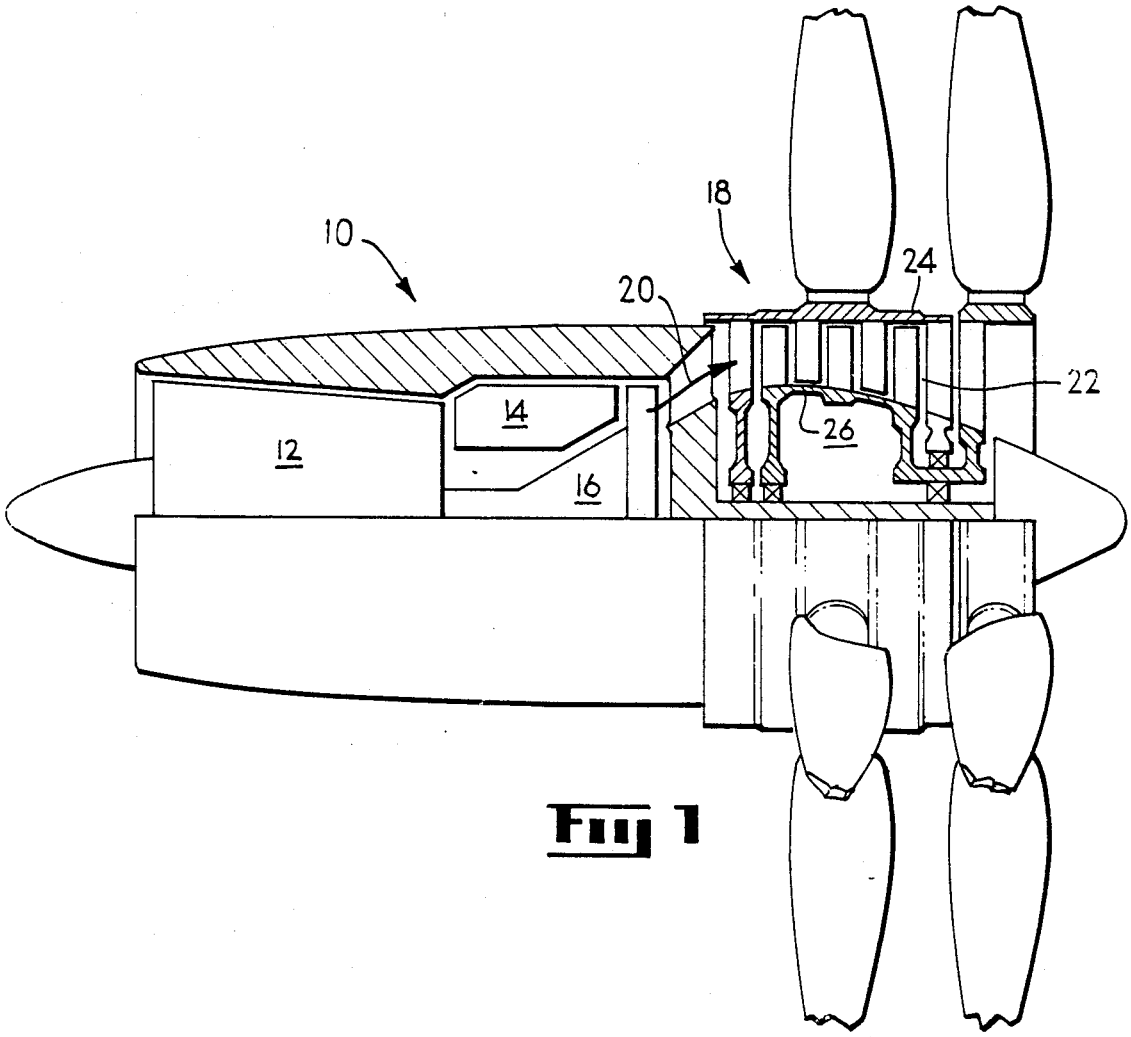
FIG. 1 is a view of a gas turbine engine which embodies one form of the present invention.

The present invention applies to any axial flow turbomachine with an annular flowpath radially bounded by outer and inner concentric casings. For example, it applies to an unducted fan engine, such as disclosed in U.S. Patent Ser. No. 437,923, now abandoned, and which is illustrated in FIG. 1. Engine 10 illustrated therein includes a compressor 12, combustor 14 and a turbine 16, all in serial flow relation. Located aft of turbine 16 is a power turbine 18. Gas 20 moving aft past turbine 16 flows through an annular flowpath 22 which is radially bounded by an outer casing 24 and an inner casing 26.

Figure 2:
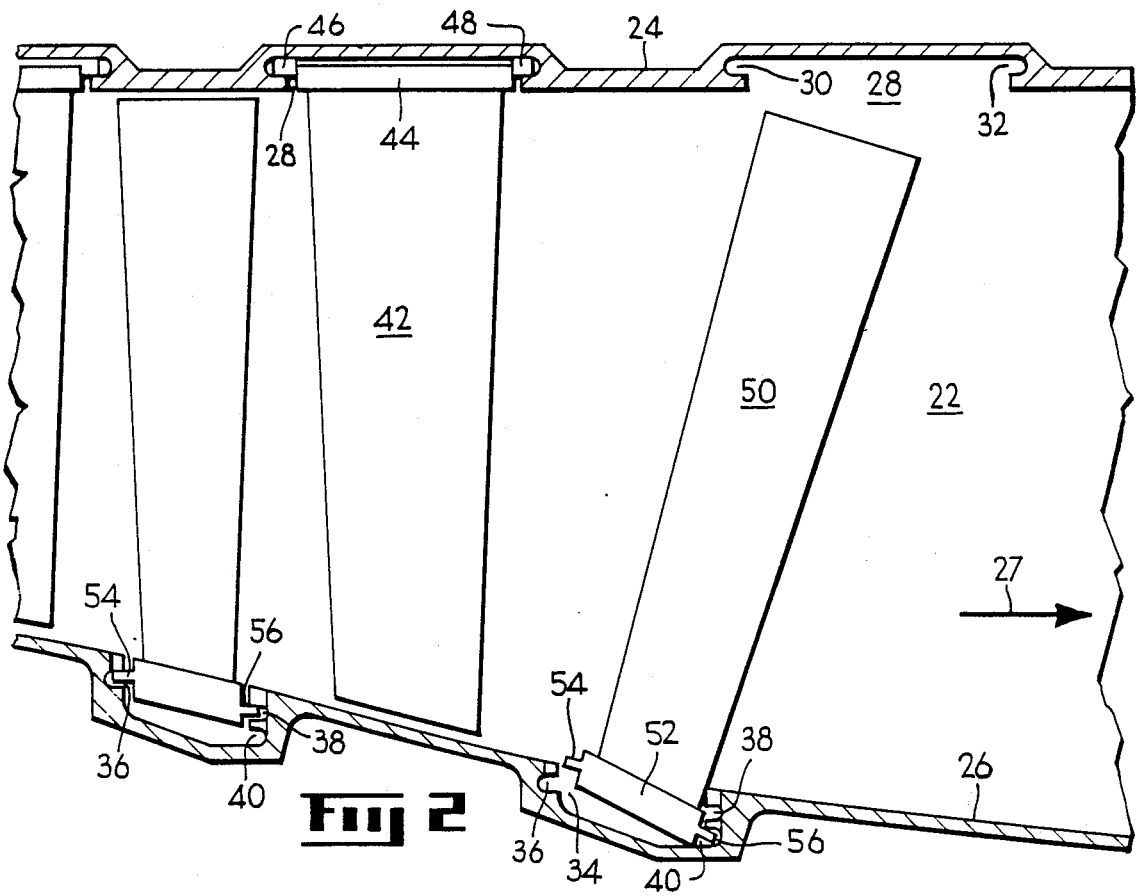
FIG. 2 is a cross-sectional side view of the casings and blades of FIG. 1 showing a first stage of installation of a blade into the inner casing.

FIG. 2 shows greater detail of annular flowpath 22, outer casing 24, and inner casing 26. In this embodiment, outer casing 24 is generally cylindrical. Inner casing 26 generally diverges from outer casing 24 in an aft direction 27 thereby assuming a generally frustoconical shape.

Both outer casing 24 and inner casing 26 are of one-piece construction, which in this context means without axial or circumferential splits. Outer casing 24 has at least one circumferential recess 28 disposed in a surface thereof which faces flowpath 22. In a preferred embodiment, outer casing 24 will include a plurality of recesses 28. Each recess 28 includes a forward circumferential slot 30 and an aft circumferential slot 32. Slots 30 and 32 are generally axially opposite.

Inner casing 26 has at least one circumferential recess 34 disposed in a surface thereof which faces flowpath 22. Each recess 34 includes a forward circumferential slot 36. Generally axially disposed from slot 36 are concentric radially outer circumferential slot 38 and radially inner circumferential slot 40. As is evident, slot 38 is disposed between slot 40 and flowpath 22.

The arrangement shown in FIG. 2 also includes a plurality of first blades 42, each having a mounting platform 44. Mounting platform 44 includes an axially forward facing tang 46 and an axially aft facing tang 48. Each of tangs 46 and 48 being adapted to mate with slots 30 and 32, respectively, in recess 28.

The arrangement also includes a plurality of second blades 50, each blade 50 having a mounting platform 52 at its base. Platform 52 has an axially forward facing tang 54 and an axially aft facing tang 56. Each of tangs 54 and 56 are adapted to mate with slots 36 and 38, respectively, in recess 34.

Figure 3:
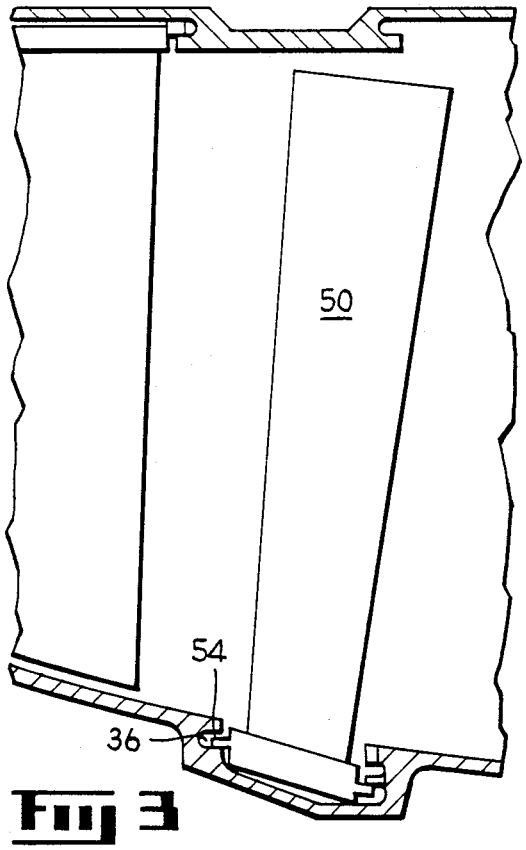
FIG. 3 illustrates a second stage of installation of the blade of FIG. 2.
Figure 4:
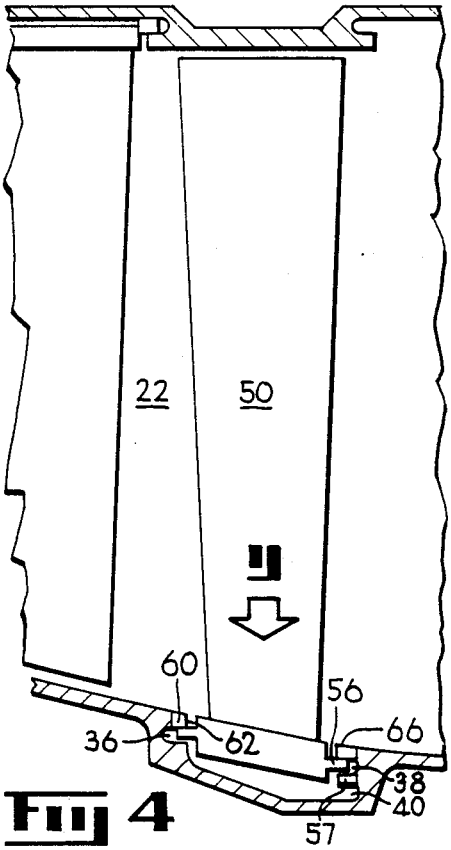
FIG. 4 illustrates the blade of FIG. 3 fully installed.

FIGS. 2, 3, and 4 illustrate in a serial view a second blade 50 being mounted into recess 34. FIG. 2 shows mounting platform 52 of a second blade 50 being assembled into recess 34 by inserting tang 56 into slot 40. FIG. 3 shows blade 50 after tang 54 has been rocked forward into slot 36. FIG. 4 shows blade 50 after tang 56 has been lifted from slot 40 into slot 38 through a relief 57 formed between these slots. Blade 50 may be translated circumferentially within slots 36 and 38 to make room for the installation of subsequent blades.

Figure 9:
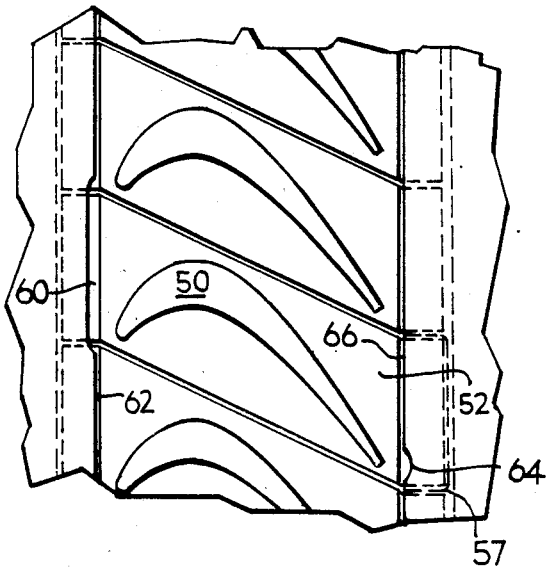
FIG. 9 is a view taken along the arrow 9 shown in FIG. 4.

Two additional features of the present invention are illustrated in FIGS. 4 and 9. These include a relief 60 formed in lip 62 between slot 36 and flowpath 22. In addition, a relief 64, shown in FIG. 9, is formed in lip 66 between slot 38 and flowpath 22. Depending upon the particular blade and platform geometry, one or both of these reliefs may be unnecessary in order for blade 50 and platform 52 to be installed as shown.

Figure 5:
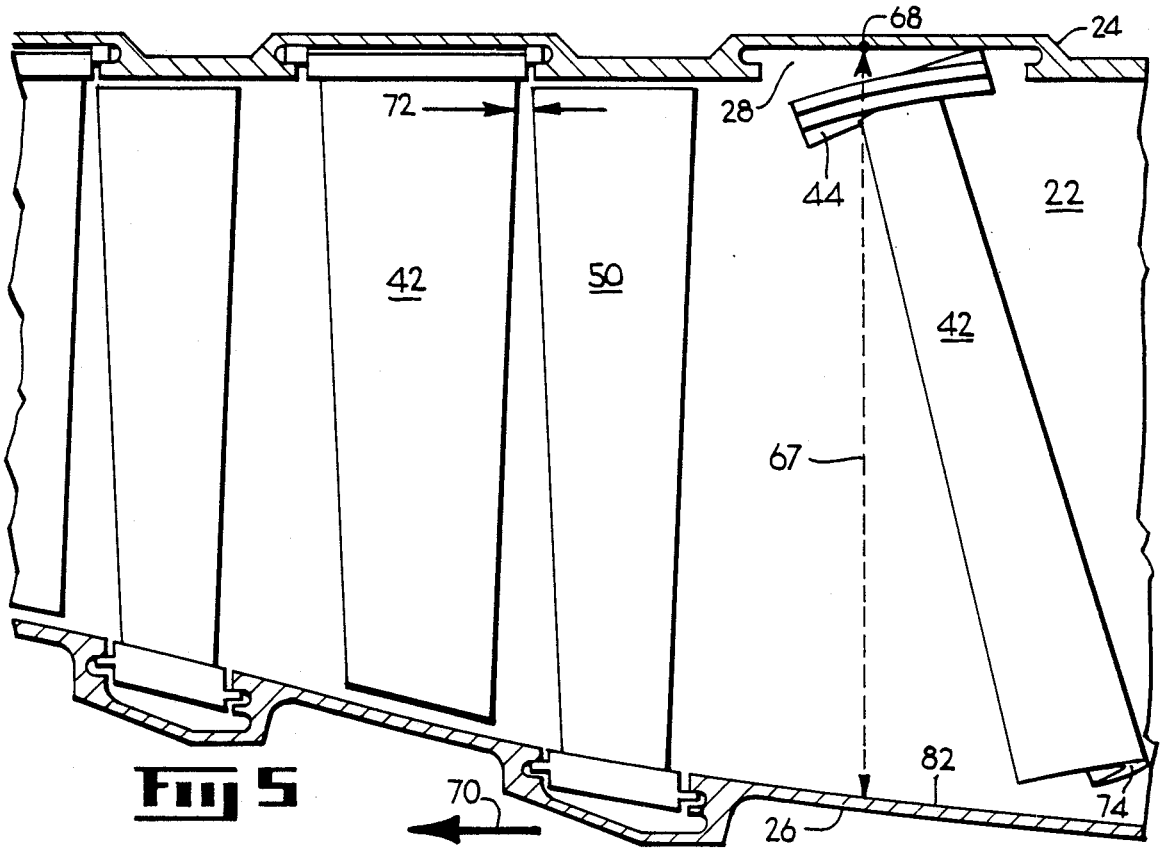
FIG. 5 illustrates a first stage of installation of a blade into the outer casing shown in FIG. 1.
Figure 6:
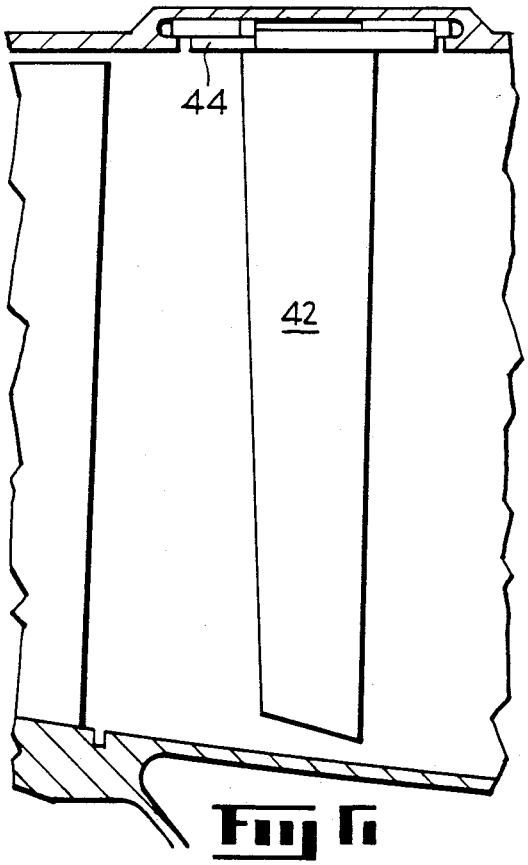
FIG. 6 illustrates a second stage of installation of the blade of FIG. 5.
Figure 7:
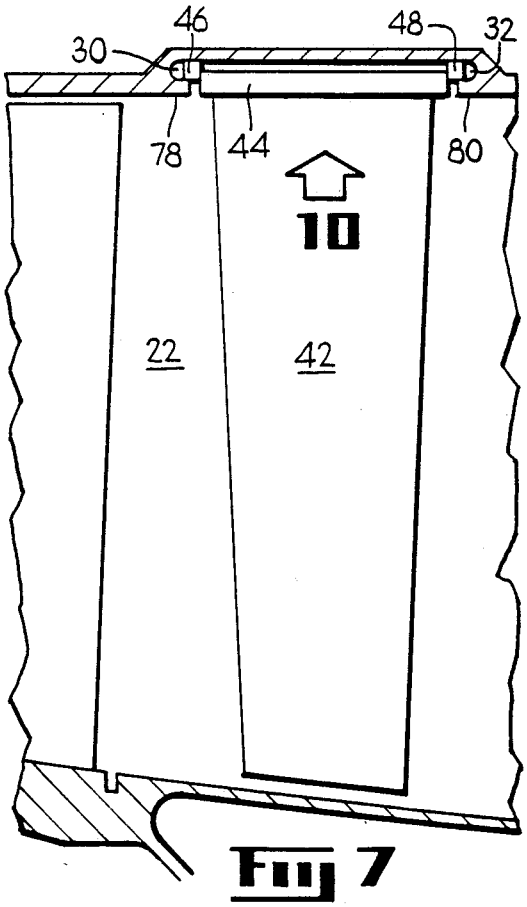
FIG. 7 illustrates the blade of FIG. 6 fully installed.

FIGS. 5, 6, and 7 illustrate a first blade 42 being assembled into recess 28. In order to increase the radial separation 67 from a point 68 on casing 24 to inner casing 26, casing 26 is axially translatable in a forward direction shown by arrow 70 with respect to casing 24. It should be clear that either or both of casings 24 and 26 may be moveable to effect this translation. Such translation will occur during assembly and, as illustrated in FIG. 5, is limited by the axial separation 72 of adjacent blades 42 and 50. In this manner, additional clearance between blade tip 74 and the flowpath facing surface 82 of casing 26 is achieved.

FIGS. 5–7 illustrate in a serial view mounting platform 44 of a blade 42 being assembled into recess 28. FIG. 5 shows a mounting platform 44 of first blade 42 being inserted into recess 28. After platform 42 is in recess 28, it is twisted so that tangs 46 and 48 mate with slots 30 and 32, respectively. FIG. 6 shows platform 44 partially twisted into position with FIG. 7 showing platform 44 fully assembled.

Figure 10:
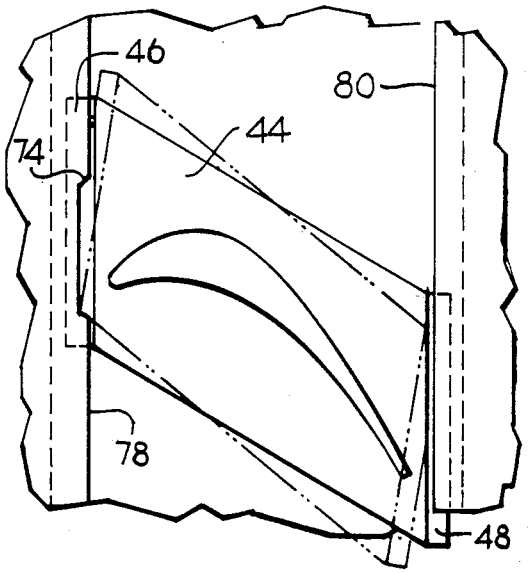
FIG. 10 is a view taken along line 10 in FIG. 7.

FIG. 10 is a view of platform 44 as it is being twisted into place. As can be seen, platform 44 has a generally parallelogram shape. Because of this geometry, it is necessary to include a relief 74 in the lip 78 formed between flowpath 22 and slot 30. It will be clear that a similar relief could be formed in lip 80 in addition to or in lieu of relief 74. It should also be clear that if platform 44 is configured so that no normal plane passes through both of tangs 46 and 48, then no such relief 74 will be necessary to facilitate the loading of blades 42. Each blade 42 may be circumferentially translated within casing 24 to allow for the loading of subsequent blades.

It will be clear that due to the twisting motion necessary to install a blade 42, there will be insufficient room to allow installation of a final blade and still maintain tight circumferential contact between adjacent blades. For this reason, it may be desirable to narrow the width of one or more blade platforms 44 to enable loading of the final blade. A final locking piece may be employed to fill in circumferential gaps resulting from the narrowed blade platform. This final locking piece or pieces may be bolted directly to casing 24 to prevent circumferential shifting of blades 42 during engine operation.

A similar blade loading problem does not exist with blades 50 because no twisting motion is necessary to install blades 50. However, it may be desirable to bolt one or more of platforms 52 to casing 26 in order to prevent circumferential shifting of blades 50 during engine operation.

Figure 8:
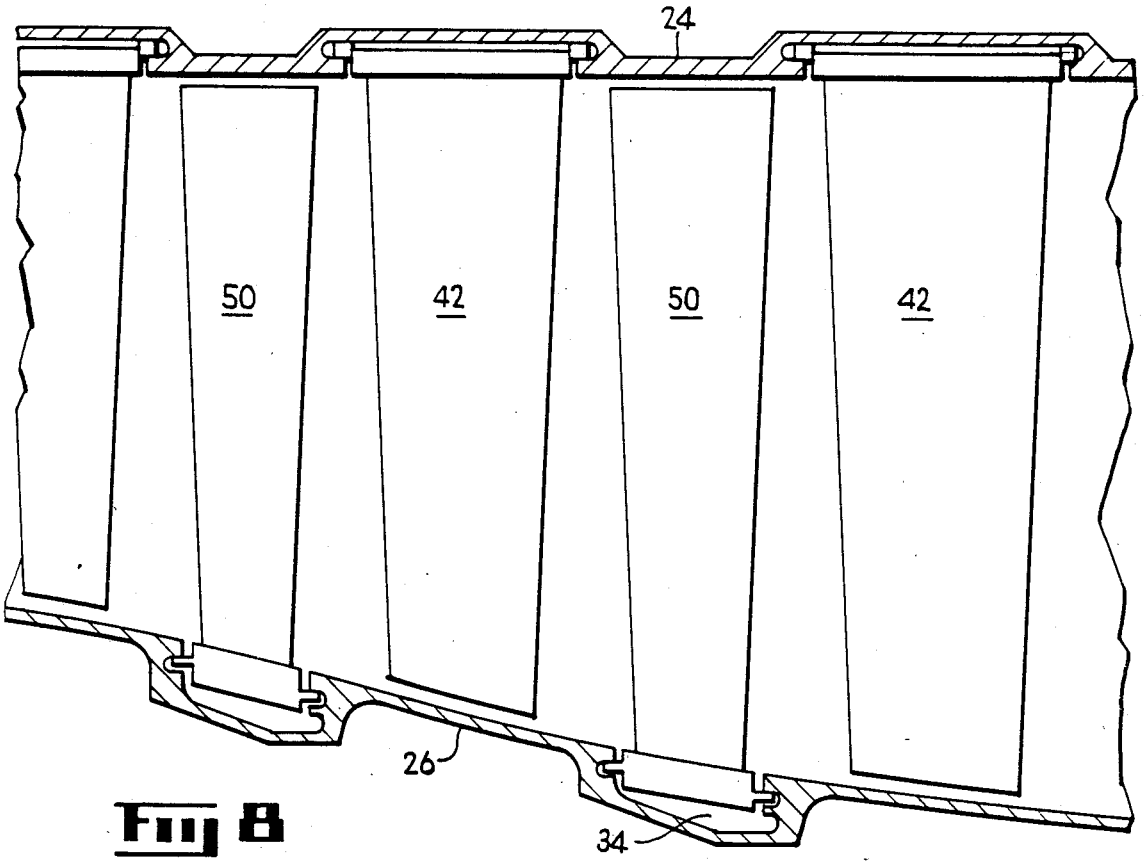
FIG. 8 illustrates a blade mounting arrangement with blades fully installed in outer and inner casings.

It should be clear from the foregoing description that a significant advantage of the present invention is the ability to install a plurality of blade rows in concentric one-piece casings. Inner casing 26 is axially translatable with respect to casing 24 to facilitate loading of blades 42. After assembly, casings 24 and 26 are repositioned as shown in FIG. 8.

It should be clear to a person skilled in the art that the recess configurations for each of casings 24 and 26 may be interchangeable and either one may be used for both outer casing 24 and inner casing 26.

An advantage of the recess 34 configuration of inner casing 26, as shown, is that it permits assembly of blades 50 without twisting and with tight tip clearances without having to axially translate the casings. A further advantage of this configuration is that it is capable of accommodating blade platforms without trimming thereof to provide tangential clearance for the final blades being loaded. For example, for the high blade solidity shown in FIG. 9, platforms 52 do not have sufficient excess tangential extent to allow for trimming. Thus, the most practical way to install such blades is to provide a configuration that permits loading without twisting of the blade. A disadvantage of this configuration is that dual slots 38 and 40 add excess casing weight over the single slot arrangement as in the recess 28 slot configuration.

The recess 28 configuration of single forward and aft slots 30 and 32 is relatively simple to form and lightweight. It is a preferred arrangement for mounting blades, but requires blade platforms 44 with sufficient excess tangential length to allow trimming thereof for assembly of final blades. Under certain conditions, it may be impossible or impractical to shift casings 26 and 24 relative to each other during loading. In such an instance, it may be difficult to load blades 42 without sacrificing blade tip clearances in the working engine.

According to a preferred embodiment of the present invention, casings 24 and 26 are counterrotating turbine rotors with blades 42 and 50 being mounted therein. However, either casing 24 or casing 26 could be stationary with the respective blades mounted therein being non-rotating vanes.

According to another form of the present invention, the blade mounting arrangement shown could apply to a compressor. In such an embodiment, the forward and aft directions would tend to be reversed from that shown in FIG. 8 with casing 26 diverging from casing 24 in a forward direction. Accordingly, the blades would be assembled into the casings starting with the aftmost rows and working forward.

It should also be clear that the shifting of rotors which occurs in order to facilitate the loading of blades 42 into outer casing 24 is achievable because outer casing 24 is generally cylindrical. If outer casing 24 were frustoconical in shape with increasing radius in the aft direction, casing 26 would not be axially translatable in a forward direction with respect to casing 24. Rather, interference between the tips of blades 50 and outer casing 24 would prevent such differential movement.

It will be understood that the dimensions and proportional and structural relationships found in the drawings are illustrated by way of example only and these illustrations are not to be taken as the actual dimensions or proportional structural relationships used in the blade mounting arrangement of the present invention.

Numerous modifications, variations, and full and partial equivalents can be undertaken without departing from the invention as limited only by the spirit and scope of the appended claims.

What is desired to be secured by Letters Patent of the United States is the following.

We claim:

1. In a turbomachine with an annular flowpath radially bounded by first and second concentric casings, an improvement comprising:

a one-piece first casing having at least one circumferential recess disposed in a surface facing said flowpath, each recess including axially opposite circumferential slots;

a plurality of first blades, each with axially facing tangs on a mounting platform adapted to mate with said slots in said first casing recess;

a one-piece second casing having at least one circumferential recess disposed in a surface facing said flowpath, each recess having a plurality of second blades mounted therein; and wherein said mounting platform of a first blade is assembled into said first casing recess by inserting said platform into said recess and then twisting said blade and platform so that said tangs mate with said slots of said first casing recess.

2. In a turbomachine with an annular flowpath radially bounded by first and second casings, an improvement comprising:

a one-piece first casing having at least one circumferential recess disposed in a surface facing said flowpath, each recess having a plurality of first blades mounted therein; and a one-piece second casing having at least one circumferential recess disposed in a surface facing said flowpath, each recess including a first circumferential slot and, axially disposed therefrom, concentric second and third circumferential slots, said third slot being disposed between said second slot and said flowpath; and a plurality of second blades, each with first and second axially facing tangs on a mounting platform adapted to mate with respective ones of said first slot and third slot in said second casing recess.

3. The improvement, as recited in claim 2, further comprising:

a relief formed between said second and third slots of said second casing recess;

wherein said mounting platform of a second blade is assembled into said second casing recess by inserting said second tang into said second slot, rocking said first tang into said first slot, lifting said second tang through said relief into said third slot, and circumferentially translating said second blade within said first and third slots.

4. In a turbomachine with an annular flowpath radially bounded by first and second casings, an improvement comprising:

a one-piece first casing having a circumferential recess disposed in a surface facing said flowpath, said recess including axially opposite circumferential slots;

a one-piece second casing having a circumferential recess disposed in a surface facing said flowpath, each recess including a first circumferential slot and, axially disposed therefrom, concentric second and third circumferential slots, said third slot being disposed between said second slot and said flowpath;

a plurality of first blades, each with axially facing tangs on a mounting platform adapted to mate with said slots in said first casing recess; and a plurality of second blades, each with first and second axially facing tangs on a mounting platform adapted to mate with respective ones of said first slot and third slot in said second casing recess.

5. In a turbomachine with an annular flowpath radially mounted by first and second casings, an improvement comprising:

a one-piece first casing having a plurality of circumferential recesses disposed in a surface facing said flowpath, each of said recesses including first and second axially opposite circumferential slots;

a one-piece second casing having a plurality of circumferential recesses disposed in a surface facing said flowpath, each of said recesses including a first circumferential slot and, axially disposed therefrom, concentric second and third circumferential slots, said third slot being disposed between said second slot and said flowpath;

a plurality of first blades, each with axially facing tangs on a mounting platform adapted to mate with said slots in said first casing recess; and a plurality of second blades, each with first and second axially facing tangs on a mounting platform adapted to mate with respective ones of said first slot and third slot in said second casing recess.

6. The improvement, as recited in claim 4 or 5, wherein said first casing is generally cylindrical and said second casing diverges therefrom in a first direction; and wherein said second casing is axially translatable opposite said first direction with respect to said first casing during assembly so as to increase the radial separation from a point on said first casing to said second casing.

7. The improvement, as recited in claim 6, wherein said mounting platform of a first blade is assembled into said first casing recess by inserting said platform into said recess and then twisting said blade and platform so that said tangs mate with said slots of said first casing recess.

8. The improvement, as recited in claim 7, wherein said second slot of said first casing recess defines a lip between said flowpath and said slot and wherein said lip includes a relief therein to prevent interference during twisting of said first blade.

9. The improvement, as recited in claim 4 or 5, further comprising:

a relief formed between said second and third slots of said second casing recess;

wherein said mounting platform of a second blade is assembled into said second casing recess by inserting said second tang into said second slot, rocking said first tang into said first slot, lifting said second tang through said relief into said third slot, and circumferentially translating said second blade within said first and third slots.

10. In a gas turbine engine including a turbine with an annular flowpath therethrough, an improvement comprising:

a one-piece outer casing bounding said flowpath and having a plurality of circumferential recesses disposed in a radially inner facing surface thereof, each of said recesses including axially opposite circumferential slots;

a one-piece inner casing bounding said flowpath with a plurality of circumferential recesses disposed in a radially outer facing surface thereof, each of said recesses including a forward circumferential slot and concentric aft radially outer and radially inner circumferential slots; a plurality of first turbine blades, each with axially facing tangs on a mounting platform adapted to mate with said slots in said radially inner facing surface recess; and a plurality of second turbine blades, each with forward and aft axially facing tangs on a mounting platform adapted to mate with respective ones of said forward slot and aft radially outer slot in said radially outer facing surface recess.

11. The improvement, as recited in claim 10, wherein said outer casing is generally cylindrical and said inner casing generally diverges therefrom in an aft direction;

and wherein said inner casing is axially translatable in a forward direction with respect to said outer casing during assembly so as to increase the radial separation from a point on said outer casing to said inner casing.

12. The improvement, as recited in claim 11, wherein said mounting platform of a first turbine blade is assembled into said inner facing recess by inserting said platform into said recess and then twisting said blade and platform so that said tangs mate with said slots of said inner facing recess.

13. The improvement, as recited in claim 10, further comprising:

a relief formed between said outer and inner slots of said outer facing recess;

wherein said mounting platform of a second turbine blade is assembled into said outer facing recess by inserting said aft tang into said radially inner slot, rocking said forward tang into said forward slot, lifting said aft tang through said relief into said radially outer slot, and circumferentially translating said second blade within said forward and aft radially outer slots.

* * * * *